United States Patent [19]

Hiyama

[11] Patent Number: 4,647,840

[45] Date of Patent: Mar. 3, 1987

[54] CURRENT MIRROR CIRCUIT

[75] Inventor: Satoshi Hiyama, Yokohama, Japan

[73] Assignee: Kabushiki Kaisha Toshiba, Kawasaki, Japan

[21] Appl. No.: 828,701

[22] Filed: Feb. 12, 1986

[30] Foreign Application Priority Data

Feb. 14, 1985 [JP] Japan ..... 60-27383

[51] Int. Cl.[4] ..... G05F 3/26

[52] U.S. Cl. ..... 323/315; 323/907

[58] Field of Search ..... 323/315, 316, 317, 907; 330/288

[56] References Cited

U.S. PATENT DOCUMENTS 4,329,639 5/1982 Davis ..... 323/315

FOREIGN PATENT DOCUMENTS 56-39608 4/1981 Japan ..... 323/315
56-132005 10/1981 Japan .
67447 12/1982 Japan ..... 323/315
81/02233 8/1981 World Int. Prop. O. ..... 330/288
83/00397 2/1983 World Int. Prop. O. ..... 323/315

*Primary Examiner*—William H. Beha, Jr.
*Attorney, Agent, or Firm*—Oblon, Fisher, Spivak, McClelland & Maier

[57] ABSTRACT

A current mirror circuit which is not adversely effected by temperature changes and which is able to be operated by a relatively low D.C. power source voltage. The circuit includes a current source connected to the commonly connected bases of two transistors. A level shifting diode-connected transistor is connected between the current source and the collector of one of the two transistors. The base-emitter junction area of this level shifting transistor is greater than that of the first transistor so that the potential of the input node is low. The potential between the collector and emitter of the first transistor is determined by the difference in voltages of $V_{be}$ of the first transistor and the level shifting transistor. The circuit also includes either an additional current source or an additional level shifting transistor connected to the collector of the second transistor.

5 Claims, 3 Drawing Figures

CURRENT MIRROR CIRCUIT

BACKGROUND OF THE INVENTION

1. Field of the Invention

This invention relates generally to current mirror circuitry and more particularly to a current mirror circuit for an integrated circuit which is not affected by changes in temperature.

2. Discussion of the Background

Many forms of current mirror circuits have been developed, many of which have been used in integrated circuitry. It is an important requirement for such circuits that they not be effected by variation in the circuit temperature. Many of the prior art devices have not been suitable due to the effect of a change in temperature on the circuit output. Since current mirror circuits in integrated circuitry are often used in portable equipment or miniature electronic devices they often are required to operate with a low power supply voltage. In fact, some present portable equipment utilizes a single dry cell of 1½ volts as a power supply. Since this power supply will diminish as the battery gets old, it is desirable to have the circuit be operable even if the voltage of the battery drops to 0.9 volts.

One type of current mirror circuit known in the prior art is shown in FIG. 1 as including a pair of transistors 110 and 112 having their base-emitter paths connected in parallel. The bases of the two transistors are directly connected to each other and also to the collector of transistor 110. The emitters of the two transistors are both connected to ground.

The collector of transistor 110 is coupled to the collector of transistor 114. Transistor 114, resistor 116 and signal source 118 constitute an input current source. The collector of transistor 112 is connected to an output terminal.

This prior art circuit presents problems in that it does not work well where low voltages are possible. In particular, the transistor 114 will not remain operational since the emitter voltage and the collector voltage are both equal to the base-emitter offset voltage of about 0.6 volts when using a transistor with a low bias current. This limitation would preclude the operation of the circuit in low voltage circumstances.

An improved current mirror circuit is disclosed in Japanese laid-open disclosure No. 60-33717 which is assigned to the assignee of the present application. This improved current mirror circuit uses an additional current source and resistor and is operated with a low supply voltage. However, this circuit does not react well to variations in the temperature. Generally, this type of circuit is required to operate in a range of temperatures of −25° C. to 75° C. If the temperature reaches either extreme of 75° C. or −25° C., a transistor in this current mirror circuit will saturate and not operate properly. Furthermore, the input node of the circuit is coupled to a resistor, whose resistance may vary in the course of production of the device, thus causing the potential at the input node not to stabilize.

SUMMARY OF THE INVENTION

Accordingly, one object of this invention is to provide a new and improved current mirror circuit which operates over a wide temperature range.

Another object of this invention is to provide a new and improved current mirror circuit which can operate using a low supply voltage.

A further object of this invention is to provide a current mirror circuit which is simple in construction, reliable and inexpensive.

A still further object of this invention is to provide a current mirror circuit which operates properly over a wide temperature range and with a low supply voltage.

Another object of this invention is to provide a novel current mirror circuit in which the potential at the current input node is stabilized.

Briefly, these and other objects of the invention are achieved by providing a current mirror circuit having a current source connected between the bases of the transistors and the voltage supply terminal. One or both of the collectors of the transistors are connected to the current source through a diode-connected transistor. If only one of the transistors is thus connected a supplemental current source is provided between the collector of the other transistor and the voltage supply terminal.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
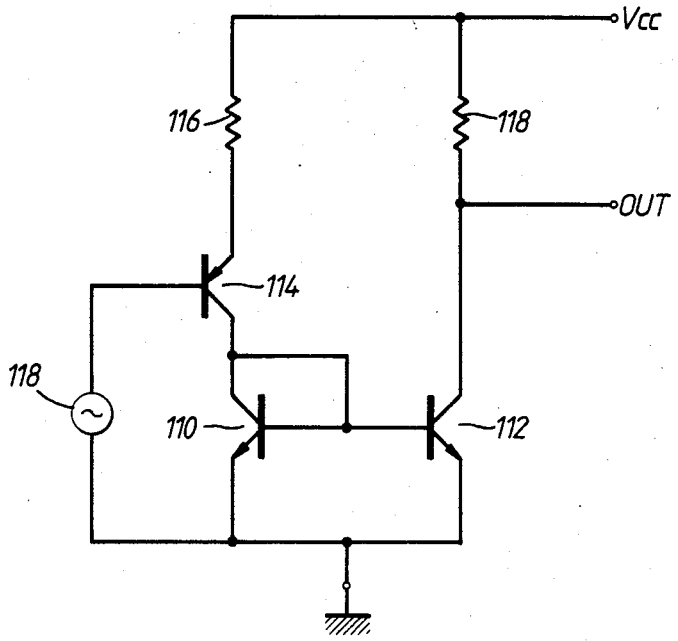
FIG. 1 is a schematic diagram of a prior art device.
Figure 2:
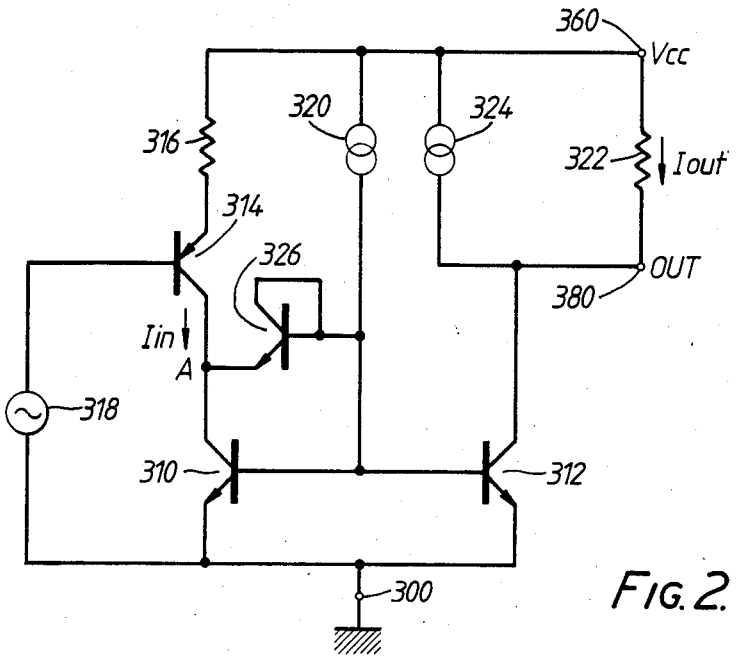
FIG. 2 is a schematic diagram of a first embodiment of the present invention.

Various other objects, features and attendant advantages of the present invention will be more fully appreciated as the same becomes better understood from the following detailed description when considered in connection with the accompanying drawings in which like reference characters designate like or corresponding parts throughout the several views and wherein FIG. 2 shows a current mirror circuit according to a first embodiment of the invention. Transistors 310 and 312 are two matched devices having the same conductivity type and characteristics and preferably being mounted on a single chip. As in the prior art device shown in FIG. 1, the bases of the two transistors are directly connected to each other. The emitters are likewise connected to each other and also to ground. The collector of transistor 310 is connected to a current input node A to which the input current is supplied from an input current source. The input current source includes a transistor 314, resistor 316 and signal source 318. This arrangement is similar to the prior art signal source seen in FIG. 1. The commonly connected bases of transistors 310 and 312 are connected to the power source voltage supply terminal 360 by way of a current source 320. The collector of transistor 312 is connected to a load resistor 322 and an output terminal 380. It is also connected to the power source voltage supply terminal 360 by way of the supplemental current source 324. The current $I_{324}$ from the supplemental current source is made to be equal to the current $I_{320}$ from current source 320. As a result of this equality and the arrangement of the circuit, the output current $I_{out}$ is equal to the input current $I_{in}$ at node A.

A diode-connected transistor 326 is connected between the collector and base of transistor 310. The emitter of diode-connected transistor 326 has a junction area of N times the area of the emitter of transistor 310.

In the operation of this circuit, the collector current of transistor 310 ($I_{c310}$) and the collector current of transistor 312 ($I_{c312}$) are:

$$I_{c310}=I_{in}+I_{320}$$

$$I_{c312}=I_{out}+I_{324},$$

where $I_{in}$=the value of the current which flows from the collector of the transistor 314 to the current input node A. $I_{out}$=the value of the current which flows through the load resistor 322.

Since both of the current sources 320 and 324 have equal currents and since the collector currents of the two transistors are equal, it follows that $I_{out}=I_{in}$.

It is seen from the circuit that the potential at the current input node A in FIG. 2 is $V_A=V_{ce310}=-V_{be310}-V_{be326}$. Therefore, the temperature coefficient is easily derived by differentiating this equation with regard to the temperature:

$$\frac{\partial V_A}{\partial T}=\frac{\partial V_{be310}}{\partial T}-\frac{\partial V_{be326}}{\partial T}$$

Since the values for the two terms on the right hand side of this equation are known to be $-2\times10^{-3}$, this equation becomes $$\frac{\partial V_A}{\partial T}=(-2\times10^{-3})-(-2\times10^{-3})=0$$

This means that the voltage at point A is essentially constant during a change in temperature.

The temperature coefficient of $V_A$ may also be described in a different manner using the expression $$V_T\left(=\frac{KT}{q}\right)\text{. Thus,}$$

$$V_A=V_T\ln\frac{I_{in}+I_{320}}{I_s}-V_T\ln\frac{I_{320}}{NI_s}=V_T\ln\frac{(I_{in}+I_{320})N}{I_{320}}$$

The right side of this equation does not include $V_{be}$, which has a large temperature coefficient but instead is dependent on $V_T$. However, the temperature coefficient of $V_T$ is a very small value and it can be shown that $$\frac{\partial V_T}{\partial T}=0.086\times10^{-3}\text{ volts/°C.}$$

Accordingly, the potential of the current input node A changes by a very small amount even when a large variation in the circuit temperature occurs.

Assuming that $I_{320}$ equals $I_{in}$ and that N is 100, then the following equation is obtained:

$$V_a(25°\text{ C.})=V_T\ln 200=0.138\text{ volts.}$$

This indicates that $V_A$ is stable since it has a fixed value. Since the collector-emitter voltage of transistor 310 needs at least 0.11 volts in order to prevent saturation, a transistor having $V_{ce}$ of 0.138 volts will remain in proper operation. Even if the temperature changes up to 75° C. or down to −25° C. the voltages will remain at a level which allows the transistor to operate properly. Thus:

$$V_A(75°\text{ C.})=V_A(25°\text{ C.})+50\times\frac{\partial V_T}{\partial T}$$
$$=0.138+50\times0.086\times10^{-3}$$
$$=0.142\text{ volts}$$

$$V_A(-25°\text{ C.})=V_A(25°\text{ C.})-50\times\frac{\partial V_T}{\partial T}$$
$$=0.138-50\times0.086\times10^{-3}$$
$$=0.134\text{ volts}$$

Both of these voltages are within a range which allows the transistor 310 and 314 not to saturate.

Furthermore, since transistor 326, which has a level shifting function, is provided, the potential at the current input node A may be lower than $V_{be}$ of the single transistor (about 0.6 volts). This means that the current mirror circuit of the present invention can be operated with a relatively low supply voltage.

Figure 3:
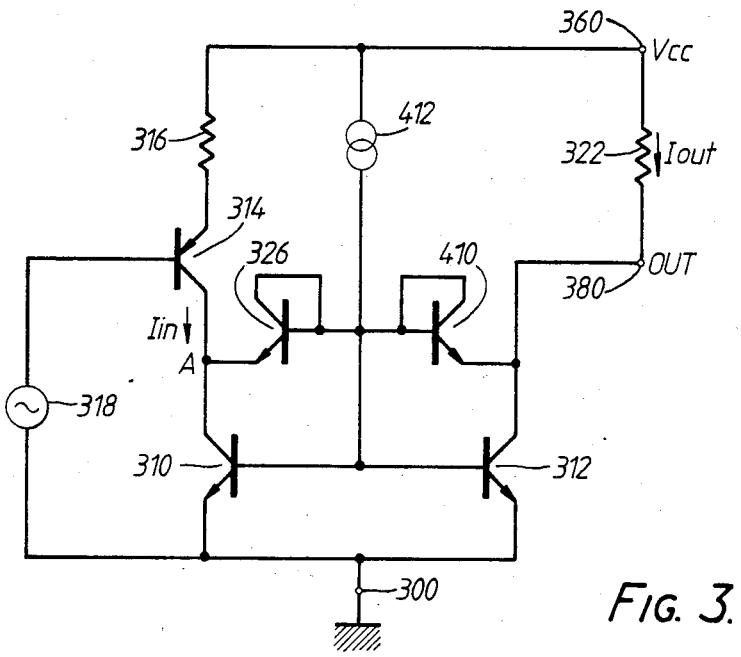
FIG. 3 is a schematic diagram of a second embodiment of the present invention.

FIG. 3 shows another embodiment of the current mirror circuit of the present invention. Most of the elements of this circuit are similar to those found in FIG. 2 and accordingly have the same numerical designation. In FIG. 3, an additional diode-connected transistor 410 is connected between the base end collector of transistor 312. At the same time, alternate power circuit 324 has been removed. Current source 412 now supplies a constant current to both transistors 326 and 410 equally. With this arrangement, the current source 412 and transistor 410 supply a supplemental current which allows the potential at the output terminal to drop. Therefore, the circuit can be operated from a lower voltage supply and can stabilize the potential of the output terminal while reducing the influence of the Early effect between the input node and the output terminal.

It is also possible to change the embodiments of FIGS. 2 and 3 by replacing resistor 316 by an additional current source. Also, in the embodiment of FIG. 2, $I_{320}$ has been described as being equal to $I_{in}$, but it is also possible to have different currents. Likewise, other choices of transistors and variations in the arrangement of the elements are possible.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A current mirror circuit comprising:

a power supply terminal;

a reference voltage terminal;

a first transistor of a first conductivity type having an emitter, a base and a collector, the emitter being connected to said reference voltage terminal and the collector being connected to said power supply;

a second transistor of the same conductivity type as said first transistor, having an emitter, a base and a collector, the emitter being connected to said reference voltage terminal;

said bases of said first and second transistors being connected to each other;

the collector of said first transistor being connected to a current input node;

current source means connected between said power supply terminal and said bases;

load circuit means connected between said power supply terminal and the collector of said second transistor; and a third transistor being diode-connected, having a junction area greater than the base-emitter junction area of said first transistor, and being connected between said collector and said base of said first transistor to apply a current from said current source means to said current input node.

2. A current mirror circuit according to claim 1, wherein said load circuit means includes a second current source means connected between said power supply and the collector of said second transistor.

3. A current mirror circuit according to claim 1, wherein said load circuit means includes a resistor connected between said power supply and the collector of said second transistor.

4. A current mirror circuit according to claim 1, wherein said first and second transistors are NPN transistors.

5. A current mirror circuit comprising:

a power supply terminal;

a reference voltage terminal;

a first transistor of a first conductivity type having an emitter, a base and a collector, the emitter being connected to said reference voltage terminal and the collector being connected to said power supply;

a second transistor of the same conductivity type as said first transistor, having an emitter, a base and a collector, the emitter being connected to said reference voltage terminal;

said bases of said first and second transistors being connected to each other;

the collector of said first transistor being connected to a current input node;

current source means connected between said power supply terminal and said bases;

load circuit means connected between said power supply terminal and the collector of said second transistor;

first diode junction means having a junction area greater than the base-emitter junction area of said first transistor, and being connected between the collector and the base of said first transistor to apply a current from said current source means to said current input node; and second diode junction means having a junction area greater than the base-emitter junction area of said second transistor, and being connected between the collector and the base of said second transistor to apply a current from said current source means to the collector of said second transistor.

* * * * *